United States Patent [19]

Regnier et al.

[11] Patent Number: 4,846,462

[45] Date of Patent: Jul. 11, 1989

[54] GIRTH MONITORING BELT

[76] Inventors: Bruce E. Regnier, 8271 Harding, Taylor, Mich. 48180; Peter A. Hochstein, 2966 River Valley Dr., Troy, Mich. 48098

[21] Appl. No.: 187,574

[22] Filed: Apr. 28, 1988

[51] Int. Cl.[4] ..... A63B 11/06; A63B 71/00

[52] U.S. Cl. ..... 272/93; 272/DIG. 5; 128/721; 128/782; 340/573; 340/574; 340/668

[58] Field of Search ..... 272/93, DIG. 4, 5; 128/68, 69, 721, 782; 340/573, 574, 668

[56] References Cited

U.S. PATENT DOCUMENTS

| | | | |
|---|---|---|---|
| 2,135,476 | 11/1938 | Rugh | 340/574 |
| 3,097,639 | 7/1963 | Streimer | 128/721 |
| 3,642,276 | 2/1972 | Kropf | 272/DIG. 5 X |
| 3,670,320 | 6/1972 | Palmer | 340/573 |
| 4,055,168 | 10/1977 | Miller et al. | 128/721 |
| 4,296,757 | 10/1981 | Taylor | 128/721 |
| 4,300,129 | 11/1981 | Cataldo | 340/573 X |
| 4,392,126 | 7/1983 | Loyola | 128/782 X |
| 4,409,992 | 10/1983 | Sidorenko et al. | 128/782 |
| 4,413,620 | 11/1983 | Tucker | 128/721 X |
| 4,665,388 | 5/1987 | Jire et al. | 272/DIG. 5 X |
| 4,706,071 | 11/1987 | Lin | 340/573 X |
| 4,750,480 | 6/1988 | Jenness | 340/688 X |

OTHER PUBLICATIONS

Schematic Symbols by Rudolf F. Graf, p. 686 of Radio Shack Dictionary of Electronics, Fourth Edition, Third Printing-1975.

*Primary Examiner*—Richard J. Apley
*Assistant Examiner*—Joe H. Cheng
*Attorney, Agent, or Firm*—Reising, Ethington, Barnard, Perry & Milton

[57] ABSTRACT

A girth monitoring belt includes a belt (12) and buckle (18) connected in series with a control enclosure (20). The control enclosure (20) includes a pair of springs (28) connected at one of their ends to the control enclosure (20) and connected at their other ends to an arm (34) which extends from within the enclosure (20) to outside the enclosure where it is connected to the belt (12). As a wearer's abdominal muscles expand, the springs (28) expand allowing the arm to slide along the enclosure (20). An electronic control circuit (38, 40) senses movement of the arm (34) past a predetermined set point which actuates an alarm (42, 43) indicating to the wearer of the undersirable condition so that the wearer will contract his muscles and allowing the springs (28) to contract moving the arm (34) within the predetermined set point turning off the alarm (42, 43). The predetermined set point is manually adjustable to vary the overall sensitivity to the amount of movement allowed.

14 Claims, 3 Drawing Sheets

GIRTH MONITORING BELT

TECHNICAL FIELD

This invention relates to an exercise device for indicating when muscles relax, and more particularly, to a device for exercising the abdominal muscles.

BACKGROUND OF THE INVENTION

Isometric or static muscle exertion has been shown to provide useful exercise and improvement in muscle tone. Most people find that exercise programs are difficult to implement because of time constraints, laziness or apathy. Improvement in overall muscle tone contributes to the general well being, but exercise of specific muscle groups can also rectify chronic aliments. More specifically, exercise to the abdominal muscle group can alleviate chronic lower back pain.

One type of abdominal muscle exercise device includes a belt connected in series with a spring means and counter which is connected around the girth or waistline of the wearer. A spring means resists the expansion of abdominal muscles and the counter records the total number of sequential muscular expansions made during an exercise period. The belt is to be worn during exercise so that periodic muscular efforts will compress the spring which will increment the counter. Such a device is shown in U.S. Pat. No. 3,278,185 issued on Oct. 11, 1966 in the name of Joseph L. Bidopia which discloses a belt exercise device which is a mechanical device having a belt connected in series with a control box having a biasing spring for compressing and incrementing a counter when the abdominal muscles are expanded and contracted. This type of device is strictly used for exercising the abdominal muscles during an exercise period for a predetermined number of times as indicated on the counter.

SUMMARY OF THE INVENTION AND ADVANTAGES

The invention is a girth monitoring belt assembly. The assembly comprises a flexible belt having a first and second end, and a buckle means attached between the first and second ends of the belt for securing the belt about the girth of a wearer. The control means is responsive to forces on the belt applied by the wearer's girth for moving past a predetermined set point and signal means are responsive to the control means when moved past the predetermined set point for providing a control signal. The signal means includes actuator means for indicating the presence of the control signal, and the control means includes manual adjustment means for varying the sensitivity of the control means by manually setting the predetermined set point.

An advantage of this type of device is that the wearer can perform useful exercise throughout the day while performing other tasks. Inadvertent relaxation of the abdominal muscles causes an increase in the effective measured circumference which will produce the control signal indicating to the wearer that the muscles have relaxed past the predetermined set point.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
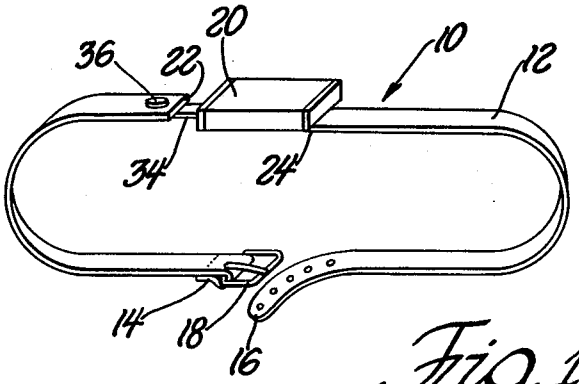
FIG. 1 is a perspective view of the subject invention.

The invention is a girth monitoring belt assembly and is generally shown at 10 in FIG. 1. The assembly 10 includes a flexible belt 12 which has a first end 14 and a second end 16, generally shown in FIG. 1. A buckle means 18 is attached between the first 14 and second 16 ends of the belt 12. The belt 12 is to be placed about the girth of the wearer and the buckle means 18 will securely hold the belt 12 thereabout.

A control enclosure 20 is in series with the buckle means 18 and the flexible belt 12 to indicate when the wearer's abdominal muscles have relaxed past a predetermined set point. The control enclosure 20 may be situated between third 22 and fourth 24 ends of the belt 12. In other words, the flexible belt 12 can be divided into two distinct portions with the control enclosure 20 securing the two portions together. As an alternative,- the buckle 18 can be connected to the second end of the belt 12. There are many alternatives to securing the belt 12 around and adjusting the length therearound, and the invention should not be limited to one of these alternatives.

Figure 2:
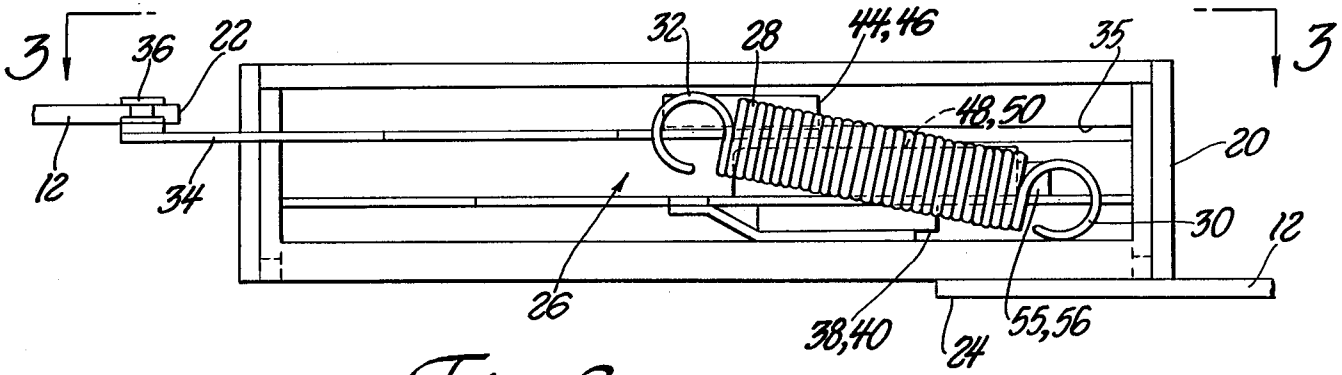
FIG. 2 is a cross-sectional side view of the control enclosure of the subject invention.
Figure 3:
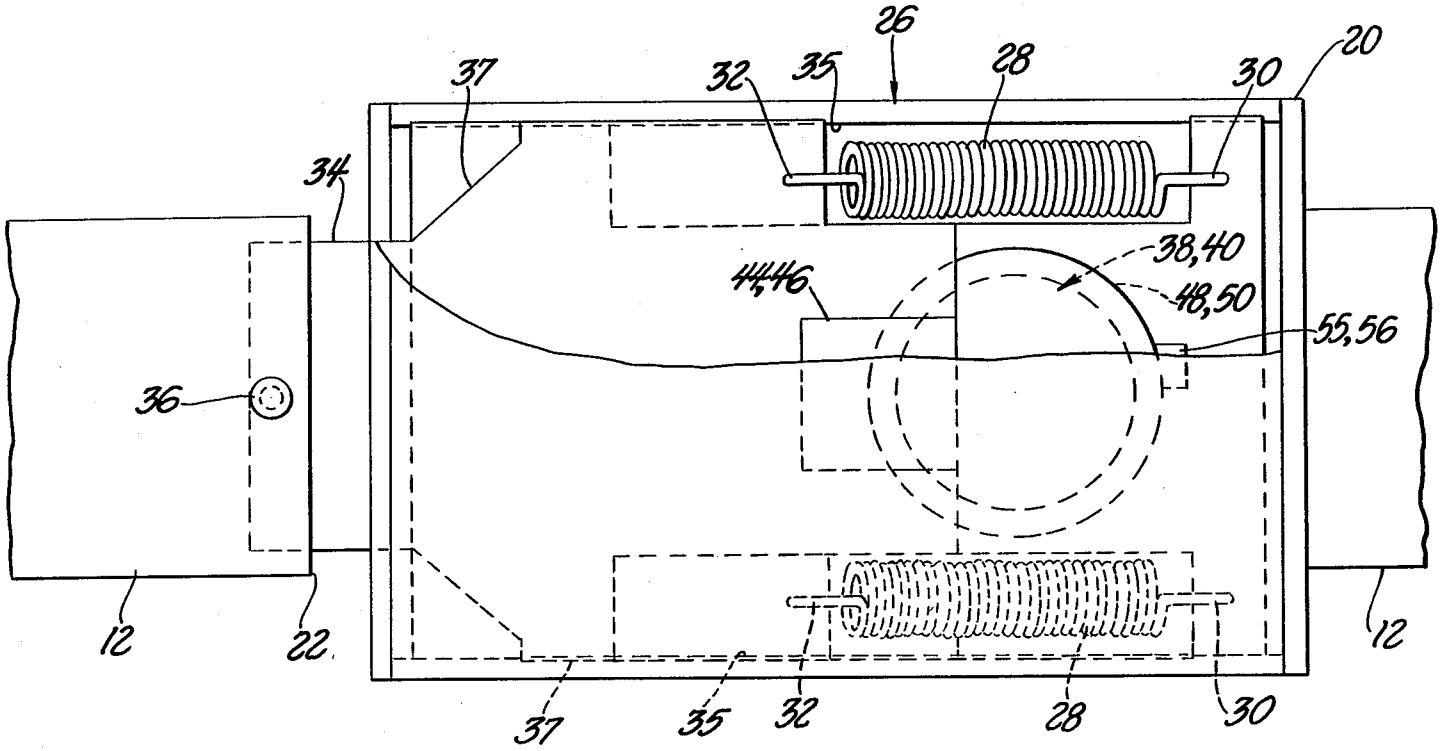
FIG. 3 is a plan view, partially broken away of the control enclosure of the subject invention.

The control enclosure 20 includes a control means generally shown at 26 in FIGS. 2 and 3, which is responsive to forces on the belt 12 applied by expansion of the wearer's girth for moving past the predetermined set point. As the wearer relaxes his abdominal muscles, the control means 26 will move within the control enclosure 20 a distance equal to the effective circumference expansion of the girth. Voluntary restriction or tightening of the abdominal muscles decreases the effective circumference of the lower torso. The change in effective circumference is monitored by the control means 26, which translates the circumferential distention into a linear motion of the control means 26.

The control means 26 includes spring means 28 having a first spring end 30 and a second spring end 32. The first spring end 30 is attached to the control enclosure 20 and the second spring end 32 is attached to the third end 22 of the belt 12 for biasing the belt 12 to within an allowable movement range less than the predetermined set point distance. The spring means 28 resists expansion allowing the belt 12 to remain secure about the wearer. When the wearer's abdominal muscles expand, the spring means 28 will be forced to extend. The spring means 28 may be a simple helical extension spring 28 or the like.

The control means 26 further includes a sensing arm 34 connected between the second spring end 32 within the control enclosure 20 and the third end 22 of the belt 12 outside the control enclosure 20. In other words, the sensing arm 34 extends from within the control enclosure 20 to outside the control enclosure 20. The sensing arm 34 moves in linear motion extending the spring means 28 in response to the change in effective circumference of the belt 12. When the muscles are constricted, the spring means 28 contracts pulling the sensing arm 34 further within the control enclosure 20 which will allow the belt 12 to remain secure about the torso of the wearer. Also included is connecting means 36 for connecting the sensing arm 34 to the belt 12. The connecting means 36 may be a snap, or the like, for connecting the belt 12 to the sensing arm 34. In a preferred embodiment, a pair of parallel springs 28 are used to interconnect the control enclosure 20 and the sensing arm 34. This allows for a uniformly linear extension of the sensing arm 34 out of and into the control enclosure 20. The control enclosure 20 may include parallel guideways 35 for guiding sides of the sensing arm 34 in a parallel motion into and out of the control enclosure 20. The sensing arm 34 may have extensions 37 extending from a generally rectangular sensing arm 34 to be inserted with the guideways 35 for horizontally guiding the sensing arm 34.

Figure 4:
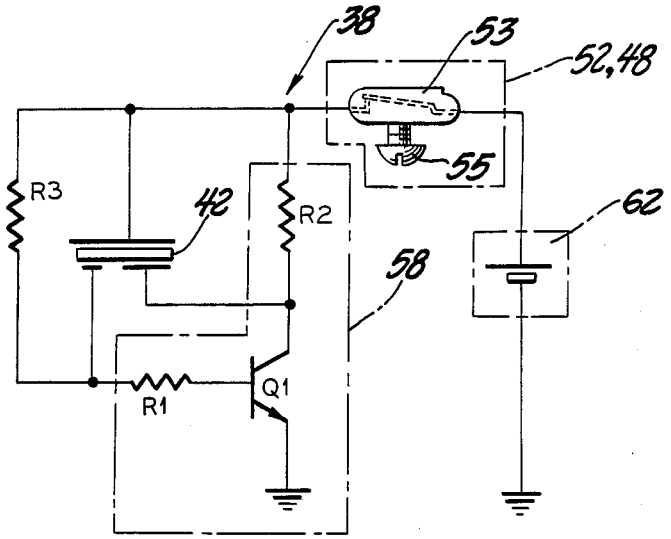
FIG. 4 is a circuit diagram for the first embodiment of the signal means of the subject invention.
Figure 5:
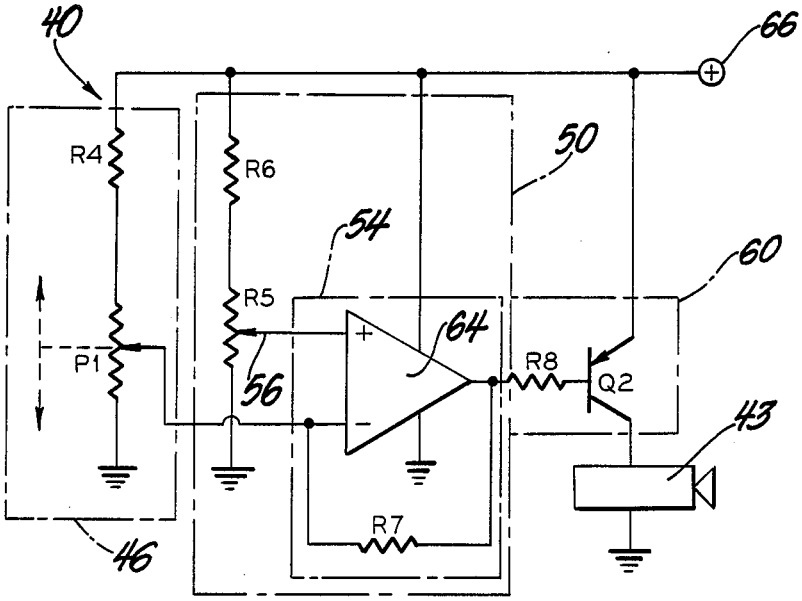
FIG. 5 is a circuit diagram for the second embodiment of the signal means of the subject invention.

Also included is signal means 38, 40 responsive to the control means 26 moving past the predetermined set point for providing the control signal. The signal means 38, 40 includes actuator means 42, 43 (as shown in FIGS. 4 and 5) responsive to the control means 26 for indication when the belt 12 has extended beyond the predetermined set point. The actuator means 42, 43 can be an alarm means responsive to the control signal for audibly indicating when the belt 12 has extended beyond the predetermined set point. Alternatively, the actuator means 42, 43 can be any type of indicator, such as a light, to attract the attention of the wearer.

The signal means 38, 40 includes trigger means 44, 46 (as shown in FIGS. 4 and 5) and sensing means 48, 50 for producing a control signal when the control means 26 is moved past the predetermined set point. The trigger means is secured to the sensing arm 34 for moving with the control means 26. The sensing means 48, 50 senses when the trigger means 44, 46 reaches the predetermined set point. The signal means 38, 40 further includes switch means 52, 54 for connecting the control signal to the actuator means 42, 43 when the control means 26 is extended beyond the predetermined set point. In other words, when the trigger means 44, 46 is moved past the predetermined set point, the switch means 52, 54 is closed which connects the control signal to the actuator means 42, 43. When the trigger means 44, 46 is not past the predetermined set point, such as when the abdominal muscles and therefore spring means 28 contract, the switch means 52, 54 is opened disconnecting the control signal from the actuator means 42, 43. The signal means 38, 40 further includes driver means 58, 60 for producing the control signal in response to the switching means 52, 54. The switch means 52, 54 closes which connects a battery 62 or power source 66 through the driver means 58, 60 to the actuator means 42, 43 to produce the alarm.

The control means 26 includes manual adjustment means 55, 56 for varying the sensitivity of the control means 26 by manually setting the predetermined set point. The set point is adjusted so that the allowable movement range that the wearer's abdominal muscles may extend or relax before closing the switch means 52, 54 can be adjusted.

The control means 26, signal means 38, 40 and switch means 52, 54 of the subject invention can be implemented by two different embodiments. The first embodiment uses a magnetic reed switch attached to the control enclosure 20, and the second embodiment uses a potentiometer.

In the first embodiment, as shown in FIG. 4, the switch means 52 and sensing means 48 is comprised of a magnetic reed switch 53 which is attached to the control enclosure 20, and the trigger means 44 is comprised of a magnet attached to the sensing arm 34 for closing the reed switch 52 when the magnet 44 is aligned therewith. Inadvertent relaxation of the abdominal muscles causes an increase in the effective measured circumference thereby extending the sensing arm 34. Such movement may be sufficient to physically slide the permanent magnet over the reed switch 53 which activates the alarm means 43. Activation of the reed switch actuates the acoustic alarm buzzer which then informs the wearer of the undesirable distention. The wearer puts on the device 10 by constricting his muscles and tightening the adjustable belt 12. In this position with the spring means 28 retracted, the magnetic reed switch 53 is kept open which keeps the alarm 42 off. Keeping the alarm 42 off therefore constitutes the isometric exercise by forcing the wearer to willfully keep his muscles tightly constricted.

As shown in FIG. 4, the signal means 38 includes a battery 62, such as 3 volts, which is connected to the driver means 58 and alarm 42 through the switch 53. When the switch 53 is closed, power is supplied to the driver means 58 which turns on the alarm 42. The driver means 58 includes a transistor Q1 having a base resistor R1 connected to the base of the transistor Q1, a collector resistor R2 connected between the switch 52 and transistor Q1, a limiting resistor R3 connected between the switch 53 and base resistor R1, and a piezoelectric alarm connected to the switch 53, the collector of the transistor Q1 and the base resistor R1. The addition of the moveable reed mechanism 53 allows the sensitivity of the device to be adjusted, even after the device has been put on. The manual adjustment means 55 comprises means for mounting the magnetic reed switch 53 for movement along the enclosure 20 and securing the switch 53 thereto such means may be by a securing member such as a screw.

The second embodiment, as shown in FIG. 5 includes the switch means 54 being a comparator means and the trigger means 46 including a resistor R4 and potentiometer P1 which is connected to a battery 66. The sensing means 50 is voltage divider reference comprising a set point variable resistor R5 connected between ground and to fixed resistor R6 connected to the battery 66. The driver means 60 is a current amplifier transistor Q2 with its emitter connected to the battery 66. The comparator includes an operational amplifier 62 and a feedback resistor R7 connected at the inverting input. The operational amplifier 64 receives the voltage from the trigger means 46 at its inverting input. The noninverting input of the operational amplifier 64 taps variable resistor R5. The output of the comparator 54 is received by a biasing resistor R8 at the base of the transistor Q2 driving the alarm 43. Linear movement of the sensing arm 34 is converted into a variable voltage by means of the linear potentiometer P1. This change in voltage, which is a direct function of the extension, is compared to a reference voltage established by the set point variable resistor R5. The comparator then drives the driver means 60 which in turn activates an acoustic alarm. The predetermined set point is a function of manually setting the potentiometer by the manual adjustment means 56, as well known in the art for setting variable resistors, and convenient adjustments thereof can be made after this device is attached. Removal of the device by unbuckling the belt 12 simply allows the internal spring means 28 to bias the sensing potentiometer P1 to zero which forces off the alarm 43.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A girth monitoring belt (12) assembly, said assembly comprising: a flexible belt (12) having first (14) and second (16) ends, buckle means (18) attached between said first (14) and second (16) ends of said belt (12) for securing said belt (12) about the girth of a wearer, a control enclosure (20) connected in series with said buckle means (18) and said belt (12), control means (26) being housed within said control enclosure (20) and responsive to forces on said belt (12) applied by expansion of the wearer's girth for moving past a predetermined set point, signal means (38, 40) responsive to said control means (26) moving past said predetermined set point for producing a control signal, said signal means (38, 40) including actuator means (42, 43) responsive to said control signal for indicating the presence of said control signal, and said control means (26) including manual adjustment means (55, 56) for varying the sensitivity of said control means (26) by manually setting said predetermined set point for varying the amount of movement required of said control means (26) to provide said control signal.

2. An assembly as set forth in claim 1 further characterized by said signal means including switch means (52, 54) for connecting said control signal to said actuator means (42, 43) when said control means (26) extend beyond said predetermined set point.

3. An assembly as set forth in claim 2 further characterized by said control enclosure (20) including spring means (28) having a first spring end (30) and a second spring end (32), said first spring end (30) attached to said control enclosure (20) and said second spring end (32) attached to said first end (14) of said belt (12) for biasing said belt (12) and said control means (26) to a position less than said predetermined set point and extending said spring means (28) in response to forces on said belt (12) applied by expansion of the wearer's girth.

4. An assembly as set forth in claim 3 further characterized by said control means (26) including a sensing arm (34) connected between said second spring end (32) within said control enclosure (20) and said first end (14) of said belt (12) outside said control enclosure (20), and including connecting means (36) for connecting said sensing arm (34) to said belt (12).

5. An assembly as set forth in claim 4 further characterized by said sensing arm (34) including trigger means (44, 46) for establishing said predetermined set point, and said signal means (38, 40) including sensing means (48, 50) for producing said control signal when said sensing arm (34) moves said trigger means (44, 46) past said predetermined set point.

6. An assembly as set forth in claim 5 further characterized by said signal means (38, 40) including driver means (58, 60) for producing said control signal in response to said switch means (52, 54).

7. An assembly as set forth in claim 6 further characterized by said actuator means (42, 43) comprising an alarm responsive to said control signal for audibly indicating when said belt (12) has extended beyond said predetermined set point.

8. An assembly as set forth in claim 7 further characterized by said switch means (52) comprising a magnetic reed switch attached to said control enclosure (20), and said trigger means (44) including a magnet attached to said sensing arm (34) for closing said reed switch when said magnet is aligned therewith.

9. An assembly as set forth in claim 8 further characterized by said manual adjustment means (55) comprising means for mounting said magnetic reed switch for movement of said magnetic reed switch along said control enclosure (20).

10. An assembly as set forth in claim 9 further characterized by said driver means (58) comprising a transistor (Q1) responsive to closure of said reed switch for driving said alarm (42).

11. An assembly as set forth in claim 10 further characterized by said alarm (34) including a piezoelectric alarm.

12. An assembly as set forth in claim 7 further characterized by said trigger means (46) including a potentiometer (P1) and said switch means (54) including comparator means for comparing the outputs of said potentiometer and said sensing means(50), said sensing means (50) comprising a voltage divider defined by a variable resistor (R5) and fixed resistor (R6).

13. An assembly as set forth in claim 12 further characterized by said manual adjustment means (56) being the manual input to change the resistance of said variable resistor (R5).

14. An assembly as set forth in claim 13 further characterized by said driver means (60) comprising a transistor (Q2) receiving the output of said comparator means for driving said alarm (43).

* * * * *